United States Patent [19]

Beckenbach et al.

[11] 4,419,036

[45] Dec. 6, 1983

[54] APPARATUS FOR CHARGING A SHAFT FURNACE

[76] Inventors: Ulrich Beckenbach, Fontanestr. 13; Helmuth Beckenbach, An den Linden 47, both of D-4005 Meerbusch 1, Fed. Rep. of Germany

[21] Appl. No.: 334,430

[22] Filed: Dec. 24, 1981

[30] Foreign Application Priority Data

Jun. 27, 1981 [DE] Fed. Rep. of Germany ..... 3125410

[51] Int. Cl.[3] ..... C21B 7/20

[52] U.S. Cl. ..... 414/160; 266/176

[58] Field of Search ..... 414/160, 199, 205, 206, 414/208; 266/176, 184

[56] References Cited

U.S. PATENT DOCUMENTS 796,784 8/1905 Witherbee et al. ..... 414/205

4,307,987 12/1981 Legille et al. ..... 414/205

FOREIGN PATENT DOCUMENTS 1095190 of 0000 Fed. Rep. of Germany .

2449039 of 0000 Fed. Rep. of Germany .

*Primary Examiner*—Robert G. Sheridan

*Attorney, Agent, or Firm*—Hill, Van Santen, Steadman & Simpson

[57] ABSTRACT

An apparatus for charging a shaft furnace for burning and sintering materials in lump form includes a distribution column and a plurality of distribution flaps which are mounted for pivotal movement adjacent a lower cone edge of the cone and are movable by a link arrangement between different positions to form different truncated columns which are coaxial with the distribution cone and have different diameters. To control the flow and charging of material, each of the distribution flaps preferably have a deflector plate which is secured to the flap and the spaced arrangement adjacent its end.

4 Claims, 5 Drawing Figures

APPARATUS FOR CHARGING A SHAFT FURNACE

The invention relates to an apparatus for charging a shaft furnace for burning and sintering material in lump form, which material is selected from a group consisting of limestone, dolomite, magnesite, cement and the like. The apparatus includes a distribution cone, which in the vicinity of its lower cone edge has a plurality of articulated distribution flaps which are adjusted by means of a linkage that passes axially through the distribution cone and the impact surfaces of the flaps are located on a truncated cone that is coaxial to the distribution cone. A pivoting of the flaps makes it possible to vary the diameter of the base of the truncated cone.

Shaft furnaces of the aforementioned type are disclosed in German Pat. No. 2,449,039 and are heated by lateral combustion which have gas or oil burners and which chambers are distributed about the longitudinal axis of the furnace in the lower area in the furnace wall and/or by internal burners on the central axis of the furnace. A problem of obtaining a uniform heating of the charged material also occurs with such shaft furnaces. For this purpose, German Pat. No. 2,449,039 discloses mechanisms permitting a planned separation of the material fragments as a function of their size, so that under certain conditions the heating uniformity will be improved.

German Pat. No. 1,095,190 describes sector-shaped, radially pivotably mounted discharge surfaces which are arranged with a vertically displaceable, tubular apron. The apron extends round the distribution cone in such a way that a particular apron position is associated with each position of the discharge surfaces, so that a particular amount of the charge is supplied.

However, this arrangement has the disadvantage that an exact guidance of the bulk material is not possible due to the fact that the apron is only vertically movable. Particularly in the case of an exclusively edge firing of the furnace in which solid fuel is admixed with the bulk material for increasing the heating in the central area of the furnace, the aforementioned apparatus has proved inadequate. In the case of the maximum extension of the truncated cone formed by the deflector plates, the lower end thereof projects laterally beyond the aprons, whilst in the latter case of an approximately vertical position of the deflector plates, the distance between the apron and the plates is too great to permit an exact guidance of the charge.

SUMMARY OF THE INVENTION

The object of the invention is to provide a better control of the bulk material surface profile and in particular a more planned admixing of the fuel in the central area of the furnace by a suitable construction of the adjustable flaps.

According to the invention, this object is solved by deflector plates being positioned in the vicinity of the outer end of the flaps and each deflector plate has an impact surface that is substantially parallel to an impact deflection surface of the particular distribution flap.

Preferably, each flap has a single deflector plate affixed or secured thereto by a web member. Preferably the distance between each deflector plate and its respective flap decreases adjacent the outer end of the flap so that the space between the deflecting surface of the flap and the impact surface of the plate converges as it approaches the outer end of the flap.

As a result of the apparatus according to the invention, it is ensured that the distance between the lower edge of the flaps and the deflector plate is constant. The charge drops vertically into the furnace and by varying the position of the distribution flaps, the furnace can be charged in an annular manner.

DESCRIPTION OF THE PREFERRED EMBODIMENT

Figure 1:
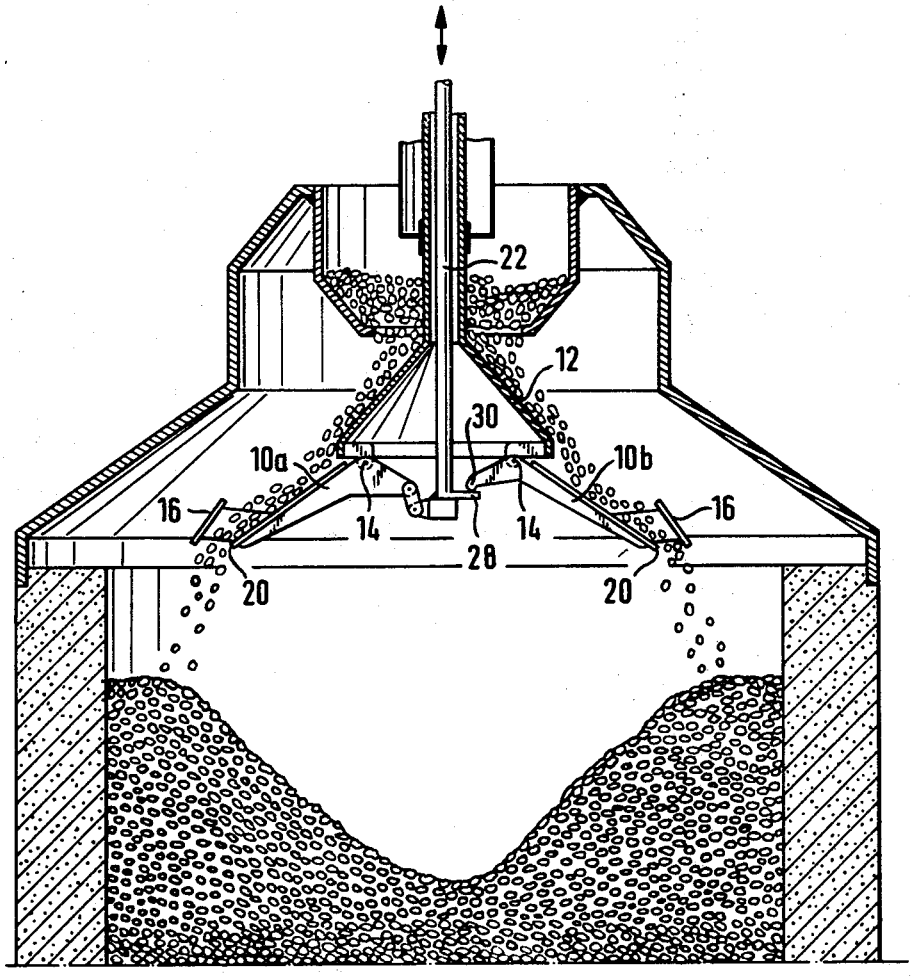
FIG. 1 is a vertical cross-sectional view of the charging apparatus according to the invention for a shaft furnace with the flaps being positioned to have their maximum projections.

FIG. 1 shows flaps 10*a* and 10*b* which are connected with distribution cone 12 by means of pivot joints 14. A deflector plate 16 is attached by a web member to each flap 10 adjacent an outer end 20 to form an opening between the plate and flap 10. The slope angle of the flaps and consequently their projection can be varied by means of a tubular linkage 22. The position of the flaps in FIG. 1 is used if in the case of edge firing of the furnace, the heating in its central area is inadequate.

Figure 2:
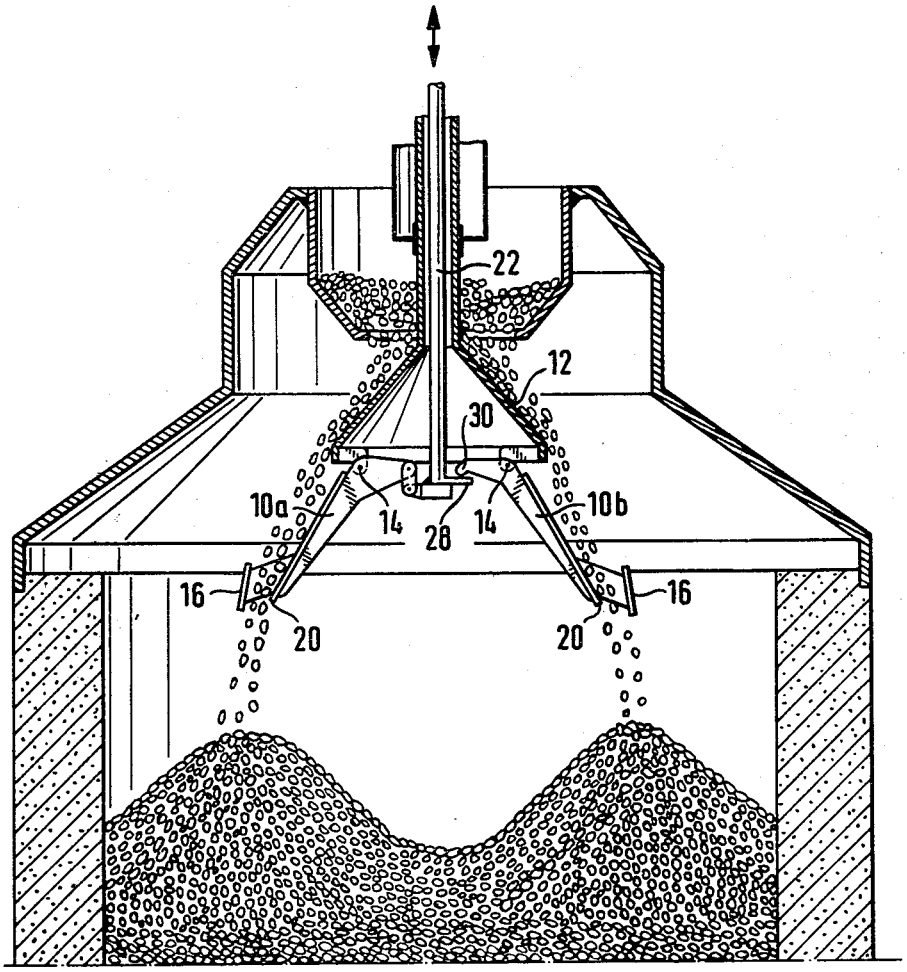
FIG. 2 is a vertical cross-sectional view of the apparatus according to FIG. 1 with the flaps in a middle position.
Figure 3:
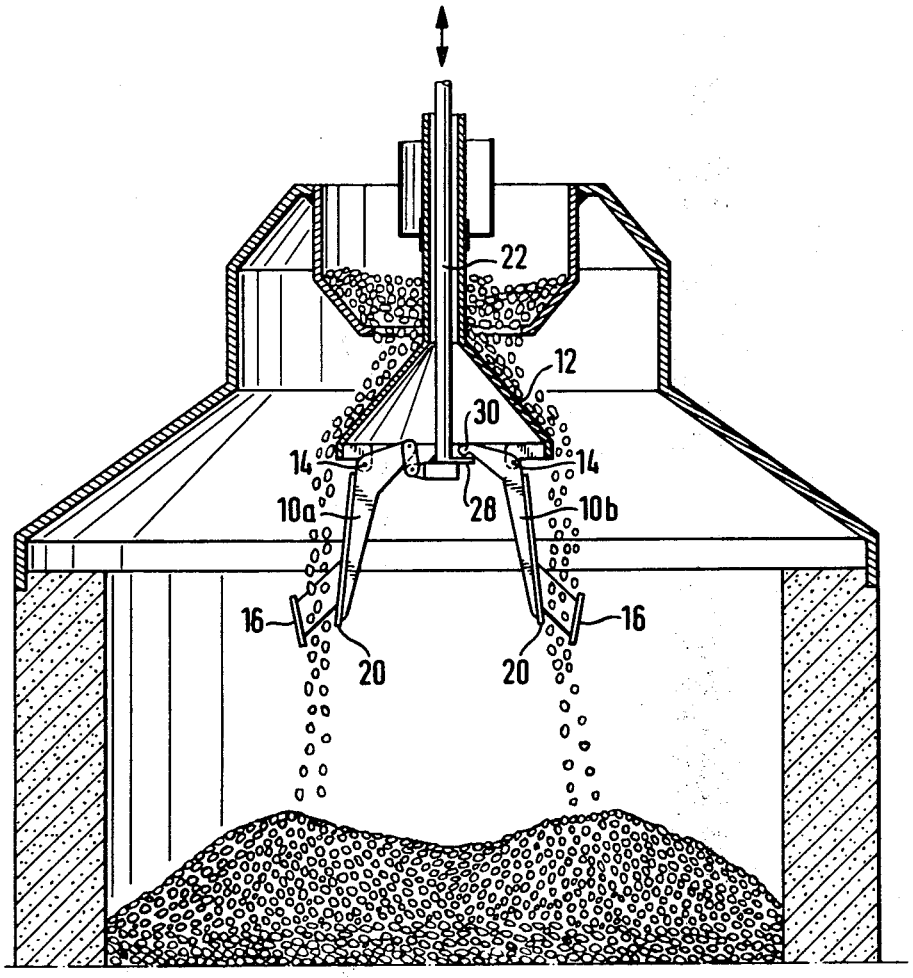
FIG. 3 is a vertical cross-sectional view of the same apparatus with the flaps close together.
Figure 4:
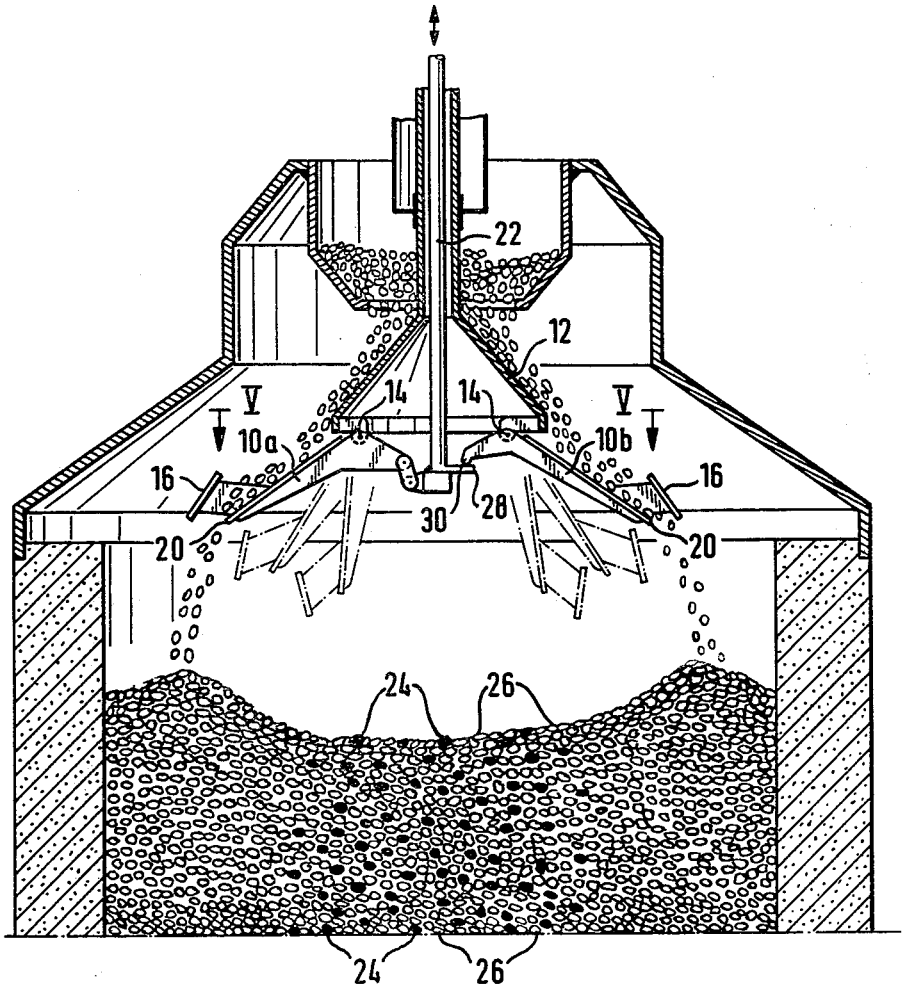
FIG. 4 is a vertical cross-sectional view illustrating charging the furnace by varying the flap position.

FIGS. 2 and 3 show the loose material profile when charging the furnace with different flap positions. FIG. 4 shows the distribution of the loose or bulk material in the furnace with modified flap positions during charging. By charging the furnace with a maximum slope of the flaps and accompanied by the admixing of solid fuel with limestone, it is possible to ensure that such a mixture only appears in the central area of the furnace.

Figure 5:
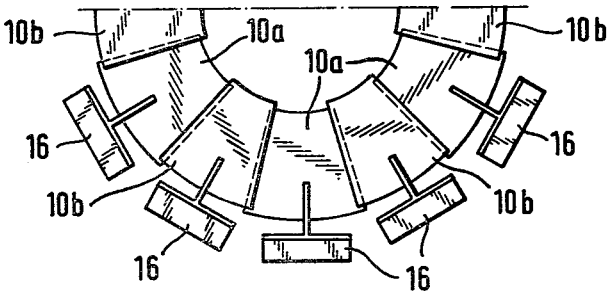
FIG. 5 is a partial plan view taken on line V—V of FIG. 4 with portions removed for purposes of illustration.

FIG. 5 shows the reciprocal or overlapping arrangement of the flaps. The lower flaps 10*a* are articulated or pivotably connected to the tubular linkage 22 and on lowering the linkage the projection of the flaps increases and the diameter of the base of the cone formed by the flaps 10*a* and 10*b* increases. The upper flaps 10*b* are raised by the lower flaps 10*a*. However, if the tubular linkage is moved upwards, flaps 10*a* and 10*b* are lowered or are pivoted from a position of FIG. 1 toward a position of FIG. 3. The lowering or pivoting of the upper flaps 10*b* is ensured by a plate 28 (FIG. 1), which presses on nose 30 of flap 10*b* and consequently brings about the lowering of the latter.

The features disclosed in the description, drawings and claims may be essential to the realisation of the various embodiments of the invention, either individually or in random combinations.

We claim:

1. In an apparatus for charging a shaft furnace for burning and sintering material in a lump form, which material is selected from a group consisting of limestone, dolomite, magnesite, cement and the like, said apparatus including a distribution cone, a plurality of distribution flaps pivotally mounted adjacent a lower edge of the cone, said flaps having impact surfaces forming a truncated cone which is coaxial to the distribution cone and means for pivoting the flaps between various positions to make it possible to vary the diameter of the base of the truncated cone, said means including a linkage passing axially through the distribution cone, the improvements comprising each of the flaps adjacent an outer end having a deflection plate arranged in spaced relation thereto to form a space therebetween, each of said deflection plates having impact surfaces extending substantially parallel to the impact surfaces of the distribution flap.

2. In an apparatus according to claim 1, wherein the distance of the space between each deflecting plate and its respective flap decreases as the outer end of each flap is reached so that the surfaces of the flap and plate converge toward each other.

3. In an apparatus according to claim 2, wherein each deflection plate is secured to its respective distribution flap by means of at least one web.

4. In an apparatus according to claim 1, which includes at least one web for each distribution flap, said web securing the deflector plate for the flap in the desired position.

* * * * *